United States Patent [19]

Cavanagh

[11] Patent Number: 4,910,939

[45] Date of Patent: Mar. 27, 1990

[54] CONSTRUCTION SYSTEM

[75] Inventor: Sean Cavanagh, Monmouth, United Kingdom

[73] Assignee: Petrus Systems Limited, London, United Kingdom

[21] Appl. No.: 94,788

[22] PCT Filed: Dec. 16, 1986

[86] PCT No.: PCT/GB86/00768

§ 371 Date: Aug. 27, 1987

§ 102(e) Date: Aug. 27, 1987

[87] PCT Pub. No.: WO87/03634

PCT Pub. Date: Jun. 18, 1987

[30] Foreign Application Priority Data

Dec. 16, 1985 [GB] United Kingdom ..... 8530955

[51] Int. Cl.[4] ..... E04H 12/00

[52] U.S. Cl. ..... 52/648; 52/64; 403/171

[58] Field of Search ..... 52/64, 299, 648, 721; 403/4, 65, 68, 157, 170, 171, 176

[56] References Cited

U.S. PATENT DOCUMENTS

| | | | |
|---|---|---|---|
| 1,347,808 | 7/1920 | Franklin | 52/648 X |
| 3,771,273 | 11/1973 | Brodie | 52/646 |
| 3,829,999 | 8/1974 | Bernstein | 52/648 X |
| 4,630,550 | 12/1986 | Weitzman | 403/171 X |

FOREIGN PATENT DOCUMENTS

| | | | |
|---|---|---|---|
| 659715 | 5/1965 | Belgium . | |
| 422760 | 12/1945 | Italy | 52/648 |
| 655534 | 4/1986 | Switzerland | 52/648 |

*Primary Examiner*—David A. Scherbel
*Assistant Examiner*—Creighton Smith
*Attorney, Agent, or Firm*—Rodman & Rodman

[57] ABSTRACT

A system for constructing staging or the like comprising beams 2,3,4,5,6 etc. (e.g. timbers) and socket elements 10,11,12,13, etc., with screws or the like to secure the beams to the socket elements. The socket elements each comprise at least three interconnected box sections for slidably receiving the beams, the box sections being open at both ends and arranged such that a first of the beams can pass through a selected one of the box sections, while at least one further beam can pass through further box sections and abut the first beam. The system generally supports cladding sheets 1, for example, for stage flooring.

11 Claims, 7 Drawing Sheets

FIG. 2a.
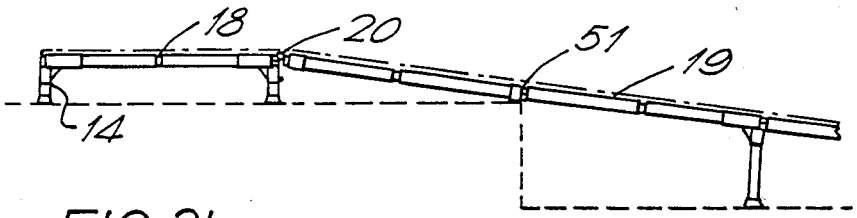
FIG. 2b.
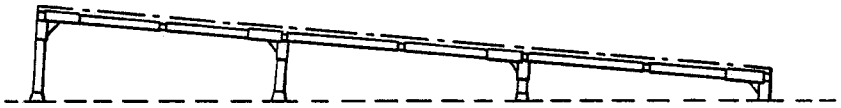
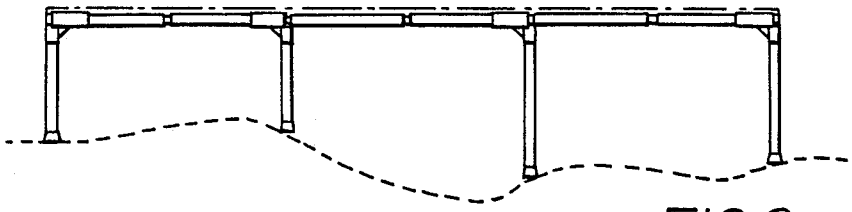
FIG. 2c.
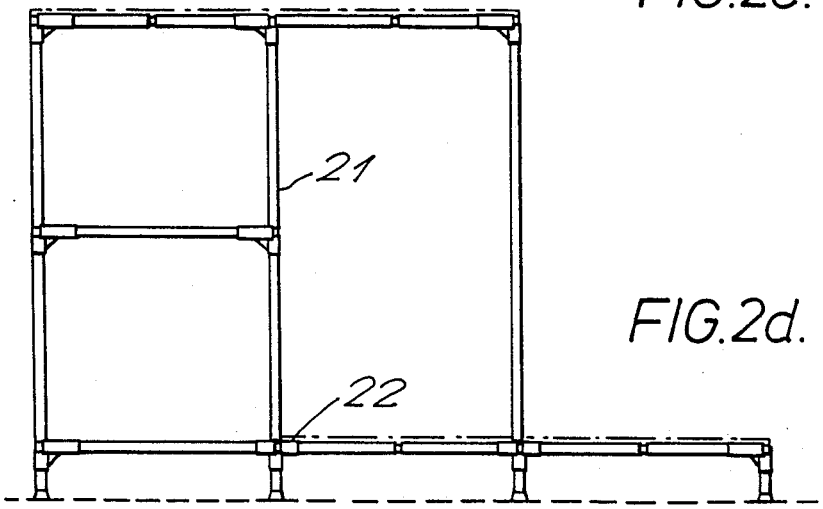
FIG. 2d.

FIG. 9.
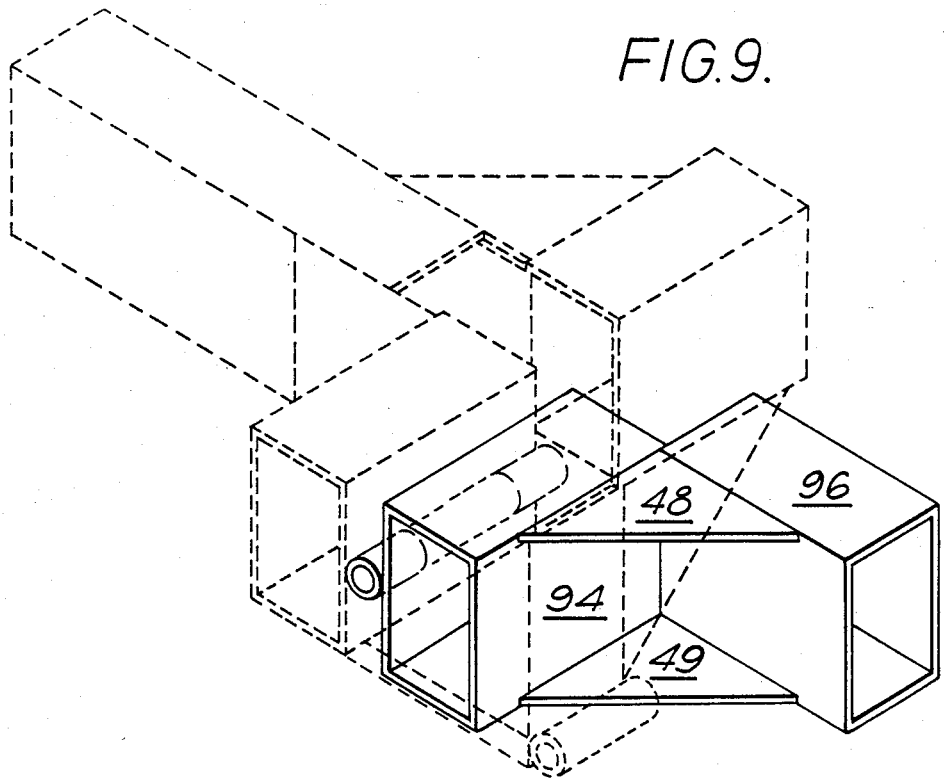
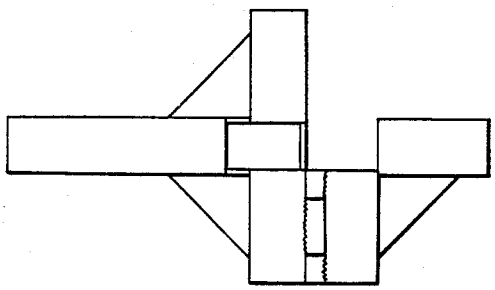
FIG. 9b.
FIG. 9a.
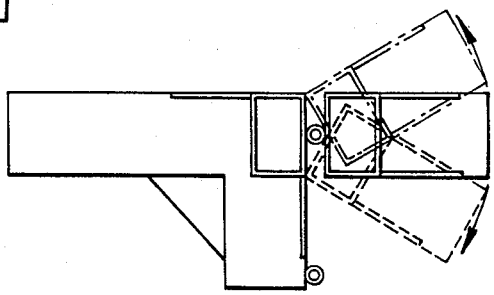

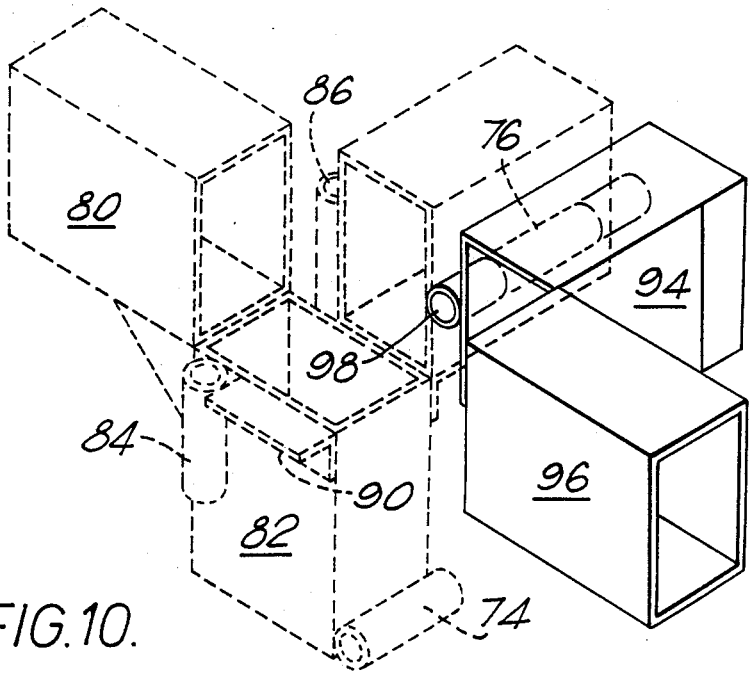
FIG.10.
FIG.10a.
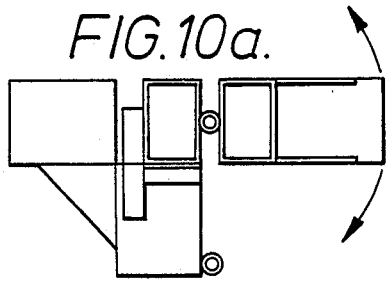
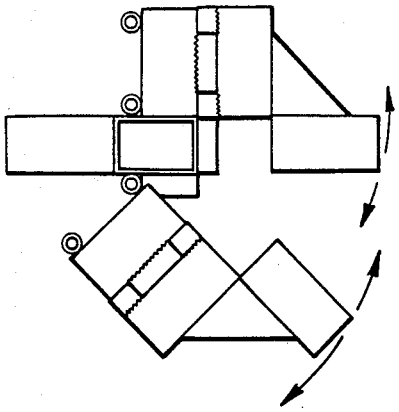
FIG.10b.

CONSTRUCTION SYSTEM

The present invention is concerned with structural construction systems which may be used, in articular, for theatrical staging or platforms, and also for purposes such as the construction of shuttering for the laying of concrete floors, scaffolding or temporary buildings.

In theatrical productions it is often required to provide a temporary stage of a particular size, shape, slope and height. In the past, it has generally been necessary either to construct the required stage in its entirety or to compromise on the stage specification so as to permit the use of existing stage components of predetermined characteristics. With respect to this latter approach, the stage components involved are normally collapsible four-walled box pens with fitting platform members, such components being readily storable. The lack of versatility of the storable stage components can be highly inconvenient and restrictive so that the expensive alternative of constructing a completely new stage for a single production is often adopted It is an object of the present invention to provide a versatile construction system which can employ readily available construction materials and is suitable for use, inter alia, for constructing stages, and which can be dismantled for storage.

According to the present invention, therefore, there is provided a construction system which comprises:

(a) a plurality of elongate structural beams;

(b) a plurality of a multi-way socket elements each comprising at least three interconnected box section members open at both ends, each capable of slidably receiving a said structural beam, said box section members being arranged such that a first of said stuuctural beams can pass through a selected one of said box section members and further ones of said structural beams can pass through respective further ones of said box section members, at least one of said further ones being arrange to abut respective edge(s) of said first structural beam; and (c) means for securing said beams to said socket elements.

The elongate structural beams used in the construction system according to the invention, are in some embodiments, all of the same cross section, which is preferably substantially rectangular. The beams are preferably of timber (although other materials, such as metals, are also envisaged). Typically, such wooden beams measure about 69mm by 44mm (a standard dimension for planed wooden beams). The socket elements are preferably of metal (such as mild steel), although other materials, such as plastics, are also envisaged. The box section members are preferably of hollow rectangular section such as to snugly receive any one of the structural beams.

The use of socket elements of the kind described can avoid the need for shaping the ends of the beams, and the latter abut directly against one another, so that they may be measured and cut to length without reference to the dimensions of the sockets. The system is flexible in that there are no constraints on the length of the beams. Since no shaping of the ends of the beams is necessary, and since a large proportion of the construction can be modular so that the beams are of a standard length, much of the system may be re-used at a later date after dismantling. Securing of the beams to the sockets need require no special tools or expertise.

The box section members constituting the socket elements used in the construction system according to the invention are preferably mutually perpendicular. In this case, since the socket elements are internally open, it is possible for the beams to extend therethrough in any one of two mutually perpendicular horizontal directions, or in the vertical direction.

Base plates may be provided for the structural beams, for mounting on the ground or floor to function as support columns for the construction. Such base plates may each consist of a metal plate to which is attached a short box section, similar to the box section members of the socket elements, and therefore dimensioned so as to receive the ends of the structural beams. The plate is preferably attached to the box section by hinge means on the end edge of the latter, such that the structural beam forming the support column may be inclined to the ground.

The socket element in the construction system according to the invention typically comprises at least three mutually perpendicular box section members interconnected at or near the free ends of the box sections. When only three box section members are present, the socket elements can generally be used as corner elements, or for edge elements, for a construction such as a staging framework. When four such box section members are employed, the socket element is suitable for use either in the body of the construction or at the edges thereof. When the socket element has five such box section members, it is suitable for use in the body of the construction.

When four or more box section members are employed, it is particularly preferred that three are of the same rectangular cross-section such as to admit the structural beams, the three members being joined to form a T i the plane of the smaller transverse edge of the respective box section members. In this embodiment, a fourth box section member projects at right angles to the junction of the T, the central region of the socket being open so that a first structural beam may be passed through it in any one of three mutually perpendicular directions, with other beams being inserted into other arms of the socket element so as to abut against the first structural beam at right angles.

The box section members may e rigidly interconnected to form the socket element, in which case the interconnection is such that all the socket elements are mutually perpendicular. However, an alternative form of socket element will be described which is adaptable for both left and right hand use and which can also be used where the angle is other than a right angle. In this form of socket element, at least one further box section may be provided with meeting hinge components at either end of a respective face to enable it to be coupled at a respective side of the center.

The socket elements described above may be provided with hinge components to enable them to be linked directly to the other hinge component of a base plate in the case where the staging slopes down to ground level.

The lengths of the box section members are preferably at least equal to the larger transverse dimension of the beams. However, some of the box section members, and in particular preferably the standard of the T, may be longer, for example, of twice this length, to allow two beams to be abutted together end to end while being securely held within the box section member. To facilitate this, the longer box section member may be provided with a pair of holes through which an aligning pin may be inserted. In assembling the staging a beam is inserted into a box section member until it rests against the aligning pin, the other beam is inserted from the other side until it also rests against the pin, and the beams are secured to the sockets, by, for instance, screws, bolts, nails, rivets, staples, wedges or the like fastening means. Such fixing means may alternatively be installed through the tops of the socket arms. The aligning pin may either be withdrawn, or may be left in place.

The invention will now be further described with reference to the accompanying drawings, in which:

FIG. 1 is a partly cut away section showing a platform constructed from a construction system according to the present invention and decked over with cladding sheet material.

FIGS. 2*a* to 2*e* are diagrams showing in elevation various constructions with systems according to the invention.

FIG. 9 shows a two-way socket with a hinge fitting suitable for use where a change of slope of the staging is required and FIGS. 9*a* and 9*b* are diagrams illustrating its operation.

FIG. 10 shows the socket of FIG. 9 used in conjunction with that of FIG. 8 to allow for both vertical and horizontal inclination of the beam and FIGS. 10*a* and 10*b* are diagrams illustrating the mode of movement allowed by this socket.

FIG. 1 shows a platform constructed from a

Figure 1:
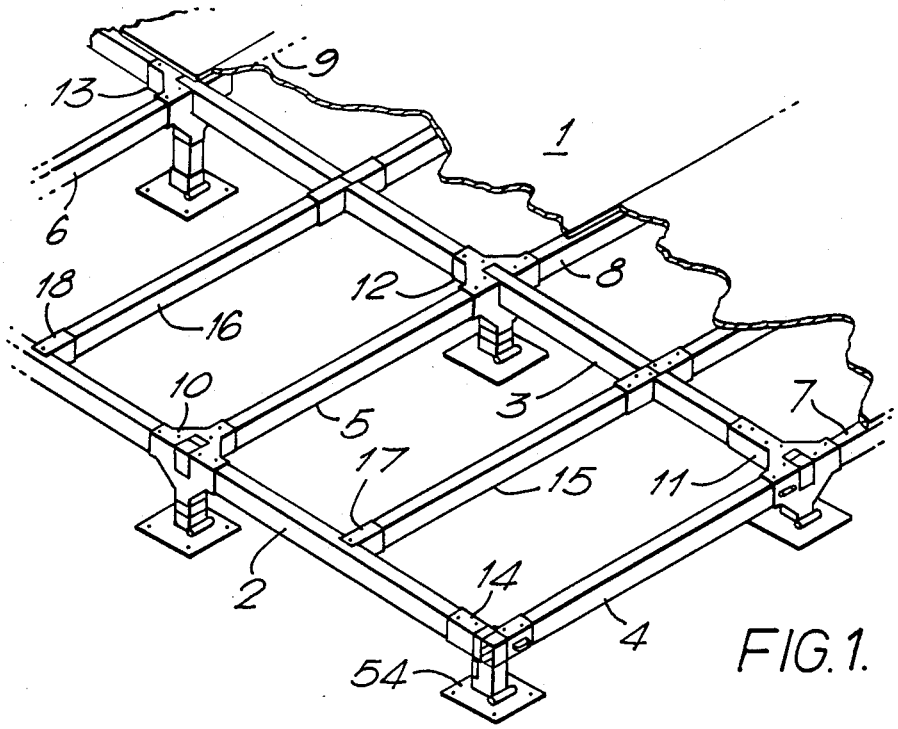

FIG. 1 shows a platform constructed from a system according to the invention, together with a supported decking panels 1, of , for example, plywood. The platform comprises longitudinal beams 2 and 3 running the whole length of the platform, and transverse beams 4,5,6, which extend between beams 2 and 3. Further transverse beams 7,8,9, extend between beam 3 and the next adjacent longitudinal beam (not shown). Where the transverse beams meet the longitudinal beams in a non-corner position, they are coupled by sockets 10,11,12,13, of a kind which will be described in more detail with reference to FIGS. 3 and 7. At the corners, a different type of socket 14 is used as will be described below with reference to FIGS. 5 and 8.

Each of the sockets 10,11,12 and 13 has a downward projecting arm which receives a beam acting as a support of the platform; each of these supports enters a base plate unit such as 54 which will be described in more detail with reference to Figure 4.

Additional strengthening beams 15,16 etc. are provided to span between longitudinal beams 2 and 3, parallel to beams 4,5,6 etc.; these additional beams both make the structure more rigid and provide additional support for the decking panels 1. These additional beams are supported from the longitudinal beams by brackets 17,18 of conventional shape.

As indicated above, the decking panels 1 are laid on top of the beams to form the decking. The panels may be laid directly on top of the beams and sockets as shown, the slight irregularities caused by the thickness of the metal of the socket arms being acceptable for many purposes. However, preferably strips of material such as rubber or felt are laid on the beams between the ends of the socket arms to provide a uniform support for the decking panels in order to serve the additional purpose of helping to deaden sound and vibration.

As further indicated above, the decking panels are typically of plywood sheets. Plywood sheets are generally available in Britain in a standard size of 8 ft by 4ft (approximately 244×122 cm). Accordingly, where a large area of staging is required, it may be constructed to a module of about 122 cm, the longitudinal beams being an exact multiple of this modular length and the transverse beams being cut to this length less the width of one beam. Such a modular construction ensures that after stage has been dismantled, the beams are largely suitable for re-use in constructing subsequent stages. Labor and material wastage is thus very much reduced and cutting and shaping operations required by previously known methods are thus largely avoided.

FIGS. 2*a* to 2*e* show in sectional elevation various forms of staging constructed using the system of the invention.

FIG. 2*a* is a construction in which a horizontal platform 18 is extended as a sloping ramp 19. Where the two portions join the change of slope is accommodated by a hinged socket 20 which will be described below in more detail with reference to FIG. 9.

FIG. 2*b* shows a sloping stage on level ground, the lengths of the beams forming the supports are graded and the base plate units 14 are hinged as will be explained below with reference to FIG. 4, to allow the ground plate itself to stand firmly on the ground although the leg is at an angle.

FIG. 2*c* shows a level staging constructed on uneven ground.

FIG. 2*d* is a construction extending to a considerable height with two levels of decking and in which for strength it is desirable that long through beams should be used for the uprights such as 21. The construction permits intermediate levels of decking directly below an upper level, as seen in the lower part of FIG. 2*d*. To accommodate the through upright beams a modified socket 22 is used and this will be described below with reference to FIG. 5.

Figure 2E:
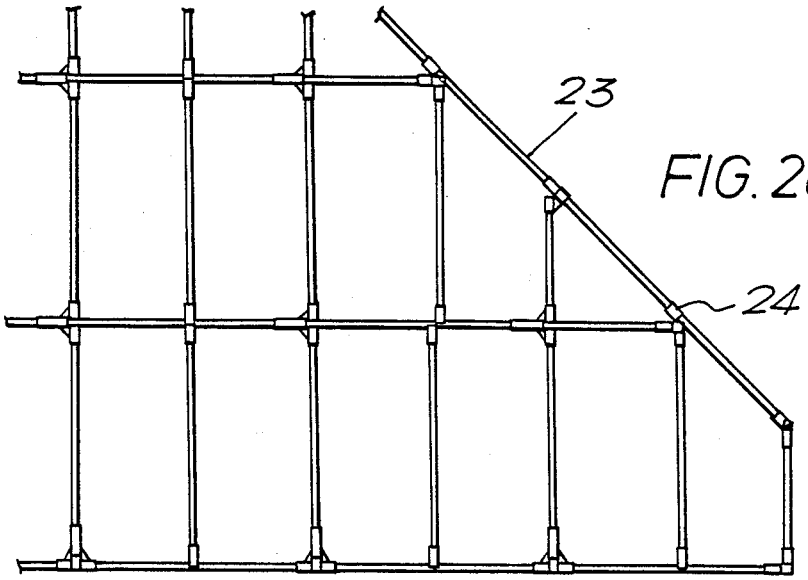

FIG. 2*e* is a plan view of staging in which one edge 23 is oblique. Where this joins the rectangular components of the staging a modified socket 24 with hinge elements is employed and this will be described with reference to FIG. 8.

Figure 3:
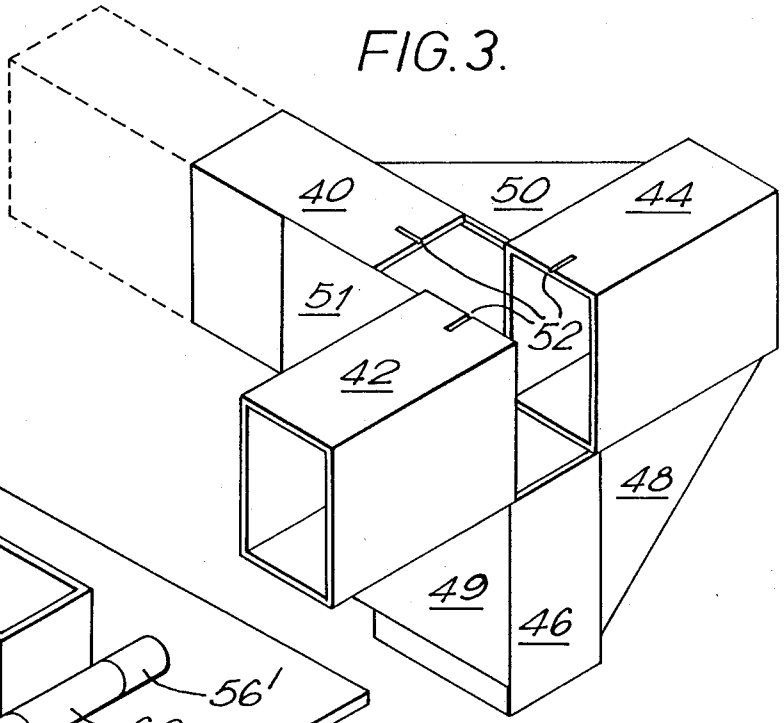
FIG. 3 is a socket for use where four or more beams meet.

FIG. 3 shows the construction of the sockets 10,11,12 of FIG. 1. The socket comprises four tubular arms of rectangular cross section, welded together at right angles, the arms 40,42,44 forming a letter T and the arm 46 projecting downwards at right angles to them. The joints are strengthened by triangular plates such as 48,49,50,51. The socket arms are cut away so that it is possible to pass a beam through the socket in any one of the three mutually perpendicular directions.

When the staging is constructed, the horizontal beams will have their longer cross section vertical for strength, so the socket will be used in the position shown in FIG. 3 with the arm 46 projecting downwards and receiving the beam which forms an upright or a support leg. The arm 40 in normal use will receive a longitudinal through beam, and preferably is made longer than the others. Where two consecutive longitudinal beams abut, the junction may then be positioned in the middle of this longer section where it will be well supported. For this purpose small holes may be provided in the middle of the top and bottom of the arm 40 for an aligning pin to be inserted against which the ends of such beams may be positioned. Screw holes and/or bolt holes (not shown) are preferably provided in the socket arms so that screws or bolts may be inserted to secure the beams to the sockets for added strength. Alignment marks such as 52 may be engraved or punched on the top surfaces at the centers of the widths of the socket arms to serve as measuring points to assist in positioning the sockets and beams during assembly.

Figure 4:
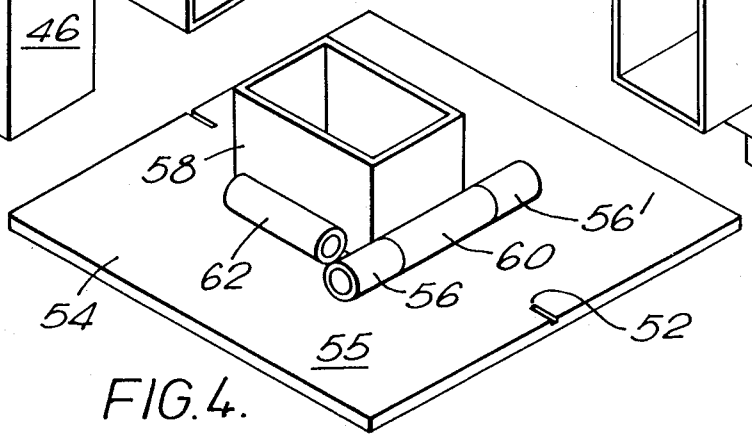
FIG. 4 is a base plate.

FIG. 4 is a base plate unit corresponding to the unit 54 of FIG. 1. It consists of a rectangular ground plate 55 bearing hinge elements 56,56' and a rectangular box section socket 58 bearing a cooperating hinge element 60. The upright beam forming a leg of the staging is inserted in the socket 58 and attached by bolts, and the hinge is typically assembled by inserting a socket cap screw (not shown) through the hinge elements 56,56',60.

Where the beam inserted in the socket 58 is at a small angle to the horizontal the position of the socket on the ground plate may be reversed so that it abuts against the edge of the ground plate. An additional hinge element 62 may be provided where a beam needs to be supported inclined to the vertical in a plane parallel to its shorter side. The ground plate may also be provided with alignment marks 52 to assist in positioning it during assembly of the staging.

The socket element, being hinged, may also be rotated to enable the support element to be passed through the socket so that the decking surface can extend over an edge of an existing stage as shown for example in FIG. 2*a* by reference numeral 51.

Figure 5:
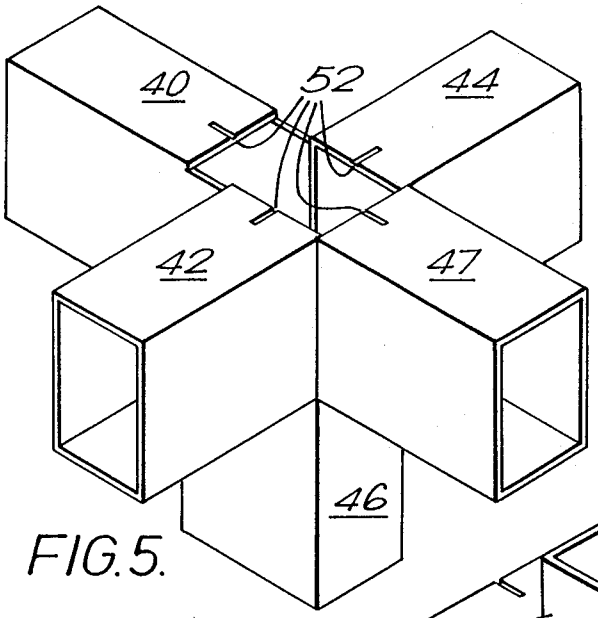
FIG. 5 is a modified form of socket for use in structures where a continuous vertical post is required or where long lengths o are required to be joined.

FIG. 5 shows a socket similar to that of FIG. 3 (and like parts are denoted by like reference numerals), but with a further box section member 47 such that the socket is suitable for use in situations such as that illustrated in FIG. 2*d* where for strength it is desirable that the through beams of the construction should b the verticals. The socket also enables consecutive beams to abut in the middle of the socket as with the long-armed version of the socket of FIG. 3. The socket consists of four horizontal rectangular section arms 40,42,44,47 and a downwardly depending vertical socket arm 46, the center of the socket being kept clear in such a way that a beam may be passed through it in any of the three mutually perpendicular directions. Alignment marks 52 and screw holes may be provided as described with reference to FIG. 3.

Figure 6:
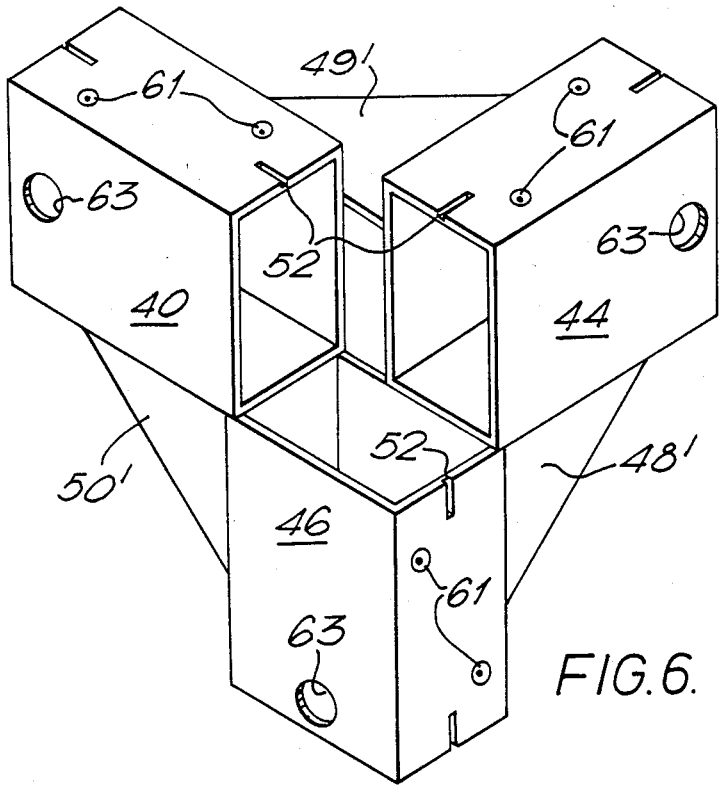
FIG. 6 is a socket suitable for use as a corner element or edge and FIG. 6*a* shows a modification of the socket element of FIG. 6, for use in corners and where long vertical columns are required.

FIG. 6 shows an exemplary socket according to the invention, as used for corners or edges of a staging construction and corresponds to the socket 13 of FIG. 1. It consists essentially of the socket of FIG. 3 with the arm 42 omitted. FIG. 6 shows screw holes 61 and bolt holes 63 by means of which the beams can be secured to the sockets. In the embodiment shown in FIG. 6, the triangular support plates 48', 49', 50' are spaced from the ends of the socket arms.

Figure 6A:
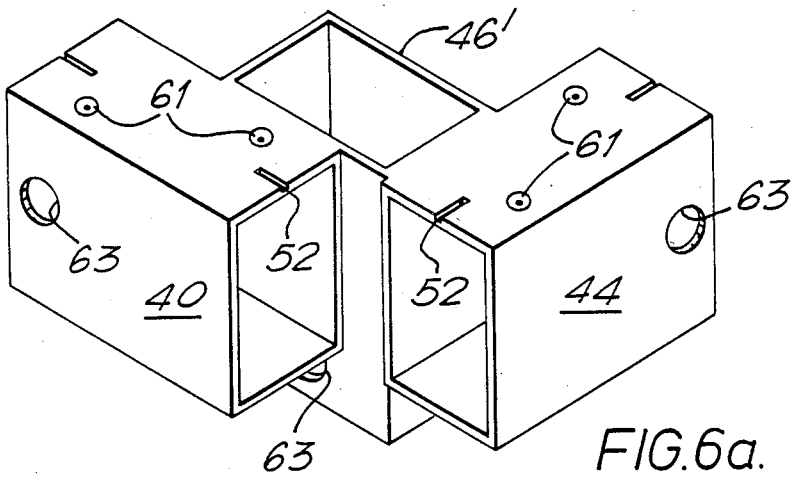

FIG. 6*a* shows a modification of the socket of FIG. 6, in which the arm 46 and plates 48', 49',50' are omitted and a further socket arm 46' is secured to the larger faces of socket arms 40,44.

Figure 7:
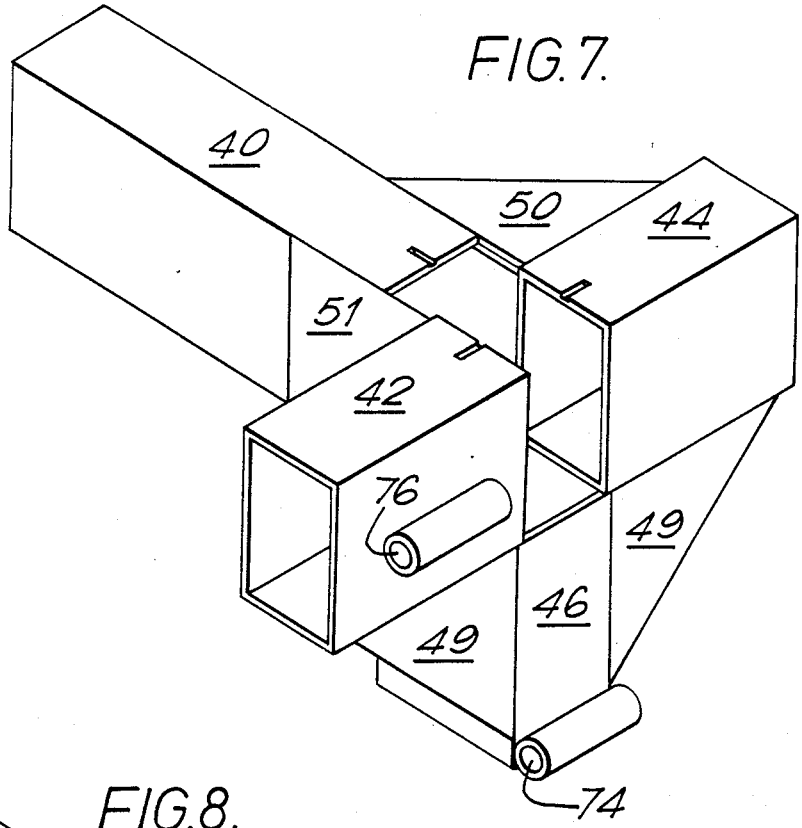
FIG. 7 shows a socket similar to that of FIG. 3 but provided with elements.

FIG. 7 shows the socket of FIG. 3 with the addition of two hinge elements, one of them 74 being provided at the lower end of the socket arm 46 and the other 76 on the outward-facing vertical face of the socket arm 42. The hinge element 74 permits this socket to be hinged directly to the ground plate 55 of FIG. 4 by inserting a socket cap screw into the hinge, as, for example, in the case of the socket 11 of FIG. 1. The hinge element 76 provides for the attachment of a further socket to be described with reference to FIG. 9 where a change in the slope of the staging occurs.

Figure 8:
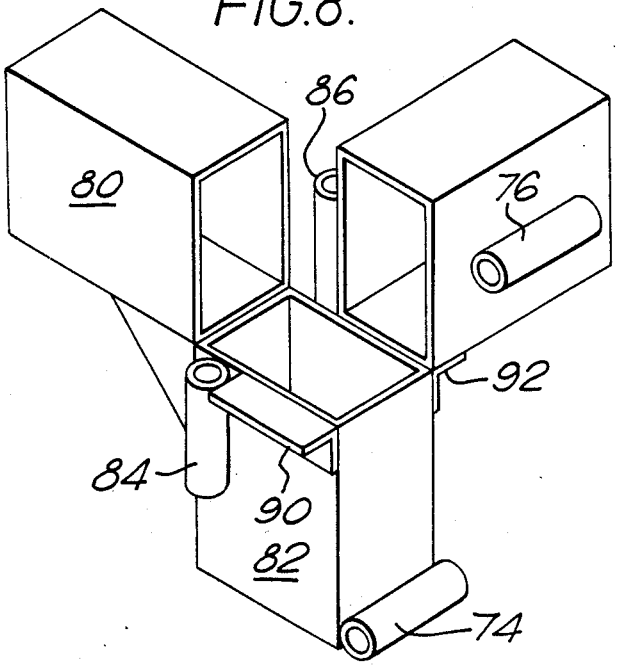
FIG. 8 is an alternative form of corner socket incorporating hinges and suitable for use where the angle of the corner is other than 90° and FIG. 8*a* is a diagram showing the utilization of socket.

FIG. 8 shows a specialized form of socket corresponding to the socket 24 of FIG. 2*e* which can also be used where beams of the staging meet at an angle other than right angle. It comprises a horizontal and a vertical socket arm 80,82 respectively, welded together at right angles, the construction being optionally made rigid by a triangular strengthening plate 48. The vertical socket arm is provided with a pair of hinge elements one of which 84 is visible and one or other of these is used in cooperation with a hinge element 86 provided on a further socket arm 88 to allow that socket arm to have an extended degree of rotational movement so as to accommodate a beam at an oblique angle to that in the socket arm 80. Optional strengthening brackets 90,92 welded to the upright socket arm 82 help to support the weight carried by the socket arm 88.

As shown in FIG. 8, hinge element 74 may be provided on the vertical socket 82 for coupling to a ground plate, and a hinge element 76 may be provided on the socket arm 88 for coupling to the socket to be described with reference to FIG. 9.

Figure 8A:
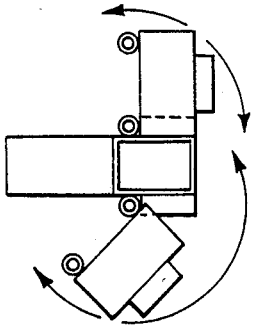

FIG. 8*a* is a diagram showing in plan view the hinging movement available with the socket of FIG. 8.

FIG. 9 shows a socket allowing hinging movement in a vertical plane such as where a change of slope is required in a staging, and corresponds to the socket 20 of FIG. 2*a*. The socket comprises two socket arms 94,96 welded together at right angles with triangular strengthening plates 48,49. The socket arm 94 carries a hinge element 98, and in the embodiment of FIG. 9 this can be secured by means of a socket cap screw or the like to the hinge element 76 of the socket of FIG. (shown in dotted lines). By means of this hinge a beam inserted into the socket arm 96 may be retained in the same vertical plane as a beam in the socket arm 40 but may be inclined to it. The action of this hinge arrangement is illustrated in elevation, and in plan respectively, in the diagrams of FIGS. 9*a* and 9*b*.

FIG. 10 shows the socket of FIG. 9, but this time hinged instead to the hinge element 76 of the socket of FIG. 8 (shown in dotted lines). In view of the foregoing description the action of this arrangement will be self evident. It allows rotation of a beam inserted into the socket arm 96 about two mutually perpendicular axes, namely those defined by the hinge elements 9 and 86. The sketches of FIGS. 10*a* and 10*b* show these movements diagrammatically respectively in elevation and in plan.

The construction system according to the invention has been described primarily with reference to staging constructions; the system can however be used for other types of construction, such as exhibition display stands, scaffolding, curtain walling, temporary or permanent constructions such as buildings and the like.

What is claimed is:

1. A construction system which comprises:

(a) a plurality of elongate structural beams;

(b) a plurality of multi-way socket elements each comprising at least three interconnected tubular box section members open at both ends, each capable of slidably receiving a said structural beam, said box section members being unobstructed right through and arranged such that a first of said structural beams can pass right through any one of said box section members without interfering with other said box section members and further ones of said structural beams can pass through respective further ones of said box section members, at least one of said further ones being arranged to abut respective edge(s) of said first structural beam; and (c) means for securing said beams to said multi-way socket elements, and wherein the elongate structural beams are timbers of substantially rectangular cross section, the box section members being fixed in, or pivotable to, mutually perpendicular orientations and wherein some of said multi-way socket elements comprise at least four box section members.

2. A construction system according to claim 1, in which three of said four box section members are of the same rectangular cross-section such as to receive said beams, said three being joined to form a T-shaped body in the plane of the smaller transverse edge of each of said three box section members, a fourth box section member projecting at right angles to the junction of the T, the central region of the socket being unobstructed so that a first said beam may be passed therethrough in any one of three mutually perpendicular directions, with other beams being insertable into other arms of said socket element so as to abut against said first mentioned beam at right angles thereto.

3. A construction system according to claim 2, in which some of said multi-way socket elements comprise three mutually perpendicular box section members.

4. A construction system according to claim 3, further comprising a plurality of base plates each comprising a rigid support to which is hinged a box section member capable of slidably receiving a said structural beam.

5. A construction system according to claim 4, in which the means for securing said beams to said socket elements comprise fasteners arranged to pass through apertures in said box section members.

6. A construction system according to claim 5, further comprising at least one socket comprising two box section members secured to one another at right angles, so as to leave an open central region through which a said beam may be passed, at least one of these box section members being provided with hinge components in combination with a further box section member provided with matching hinge components at either end of one face so as to enable it to be coupled at one or other side of said central region.

7. A construction system according to claim 6, further comprising cladding sheet material to be supported by said structural beams.

8. A construction system which comprises:

(a) a plurality of elongate structural beams;

(b) a plurality of multi-way socket elements each comprising at least three interconnected tubular box section members open at both ends, each capable of slidably receiving a said structural beam, said box section members being unobstructed right through and arranged such that a first of said structural beams can pass right through any one of said box section members without interfering with other said box section members and further ones of said structural beams can pass through respective further ones of said box section members, at least one of said further ones being arranged to abut respective edge(s) of said first structural beam; and (c) means for securing said beams to said multi-way socket elements, and wherein some of said multi-way socket elements comprise at least four box section members.

9. A construction system which comprises:

(a) a plurality of elongated structural beams;

(b) a plurality of multi-way socket elements each comprising at least three interconnected tubular box section members open at both ends, each capable of slidably receiving a said structural beam, said box section members being unobstructed right through and arranged such that a first of said structural beams can pass right through any one of said box section members without interfering with other said box section members and further ones of said structural beams can pass through respective further ones of said box section members, at least one of said further ones being arranged to abut respective edge(s) of said first structural beam; and (c) means for securing said beams to said multi-way socket elements, and wherein three of said box section members are of the same rectangular cross-section such as to receive said beams, said three being joined to form a T-shaped body in the plane of a transverse edge of each of said three box section members, a fourth box section member projecting at right angles to the junction of the T, the central region of the socket being unobstructed so that a first said beam may be passed therethrough in any one of three mutually perpendicular directions, with other beams being insertable into other arms of said socket element so as to abut against said first mentioned beam at right angles thereto.

10. A construction system which comprises:

(a) a plurality of elongate structural beams;

(b) a plurality of multi-way socket elements each comprising at least three interconnected tubular box section members open at both ends, each capable of slidably receiving a said structural beam, said box section members being unobstructed right through and arranged such that a first of said structural beams can pass right through any one of said box section members without interfering with other said box section members and further ones of said structural beams can pass through respective further ones of said box section members, at least one of said further ones being arranged to abut respective edge(s) of said first structural beam; and (c) means for securing said beams to said multi-way socket elements, and wherein said system further comprises a plurality of base plates each comprising a rigid support to which is hinged a box section member capable of slidably receiving a said structural beam.

11. A construction system which comprises:

(a) a plurality of elongated structural beams;

(b) a plurality of multi-way socket elements each comprising at least three interconnected box section members open at both ends, each capable of slidingly receiving a said structural beam, said box section members being arranged such that a first of said structural beams can pass through a selected one of said box section members and further ones of said structural beams can pass through respective further ones of said box section members, at least one of said further ones being arranged to abut respective edge(s) of said first structural beam;

(c) means for securing said beams to said socket elements; and (d) at least one socket comprising two box section members secured to one another at right angles, so as to leave an open central region through which a said beam may be passed, at least one of these box section members being provided with hinge components in combination with a further box section member provided with matching hinge components at either end of one face so as to enable it to be coupled at one or other side of said central region.

* * * * *